US007927080B2

(12) United States Patent
Müller et al.

(10) Patent No.: US 7,927,080 B2
(45) Date of Patent: Apr. 19, 2011

(54) METHOD FOR OPERATING A LIQUID RING COMPRESSOR

(75) Inventors: Christian Müller, Mannheim (DE); Martin Sesing, Waldsee (DE); Martin Fiene, Niederkirchen (DE); Oliver Huttenloch, Neulußheim (DE); Eckhard Stroefer, Mannheim (DE)

(73) Assignee: BASF Aktiengesellschaft (DE)

( * ) Notice: Subject to any disclaimer, the term of this patent is extended or adjusted under 35 U.S.C. 154(b) by 951 days.

(21) Appl. No.: 11/662,851

(22) PCT Filed: Sep. 16, 2005

(86) PCT No.: PCT/EP2005/009981

§ 371 (c)(1),
(2), (4) Date: Mar. 14, 2007

(87) PCT Pub. No.: WO2006/029884

PCT Pub. Date: Mar. 23, 2006

(65) Prior Publication Data

US 2007/0269309 A1 Nov. 22, 2007

(30) Foreign Application Priority Data

Sep. 17, 2004 (DE) ..... 10 2004 045 173

(51) Int. Cl.
*F04C 19/00* (2006.01)

(52) U.S. Cl. ..... 417/53; 417/68

(58) Field of Classification Search ..... 417/53, 417/68, 69

See application file for complete search history.

(56) References Cited

U.S. PATENT DOCUMENTS

| | | | | |
|---|---|---|---|---|
| 6,117,275 | A * | 9/2000 | Baumann | 203/1 |
| 6,783,807 | B2 | 8/2004 | Huffer | |
| 2006/0272934 | A1 * | 12/2006 | Beste et al. | 203/24 |
| 2007/0281188 | A1 * | 12/2007 | Bette et al. | 429/13 |

FOREIGN PATENT DOCUMENTS

| | | |
|---|---|---|
| FR | A 2 788 312 | 7/2000 |
| GB | 1 161 950 | 8/1969 |
| GB | 2 270 119 | 3/1994 |
| JP | 2003-528983 | 9/2003 |

OTHER PUBLICATIONS

P. Wasserscheid, W. Keim, "Ionische Flussigkeiten—neue,,Losungen" fur die Ubergangsmetallkatalyse, Angew. Chem. 2000, 112, pp. 3926-3945.

* cited by examiner

*Primary Examiner* — Charles G Freay
(74) *Attorney, Agent, or Firm* — Connolly Bove Lodge & Hutz, LLP

(57) ABSTRACT

The invention relates to a method of operating a liquid ring compressor having an impeller installed eccentrically in a compressor body, with gas being supplied to the liquid ring compressor on a suction side and gas being discharged from the liquid ring compressor on a pressure side. A liquid ring is generated in the liquid ring compressor on the inside of the compressor body by rotation of the impeller. Chambers are formed between blades of the impeller and the liquid ring and gas is drawn into these. The gas is compressed in the chambers which become smaller from the suction side to the pressure side as a result of the rotation of the eccentrically mounted impeller. The compressed gas is ejected on the pressure side. An ionic liquid is used as service liquid for generation of the liquid ring.

11 Claims, 2 Drawing Sheets

METHOD FOR OPERATING A LIQUID RING COMPRESSOR

RELATED APPLICATIONS

Figure 1:
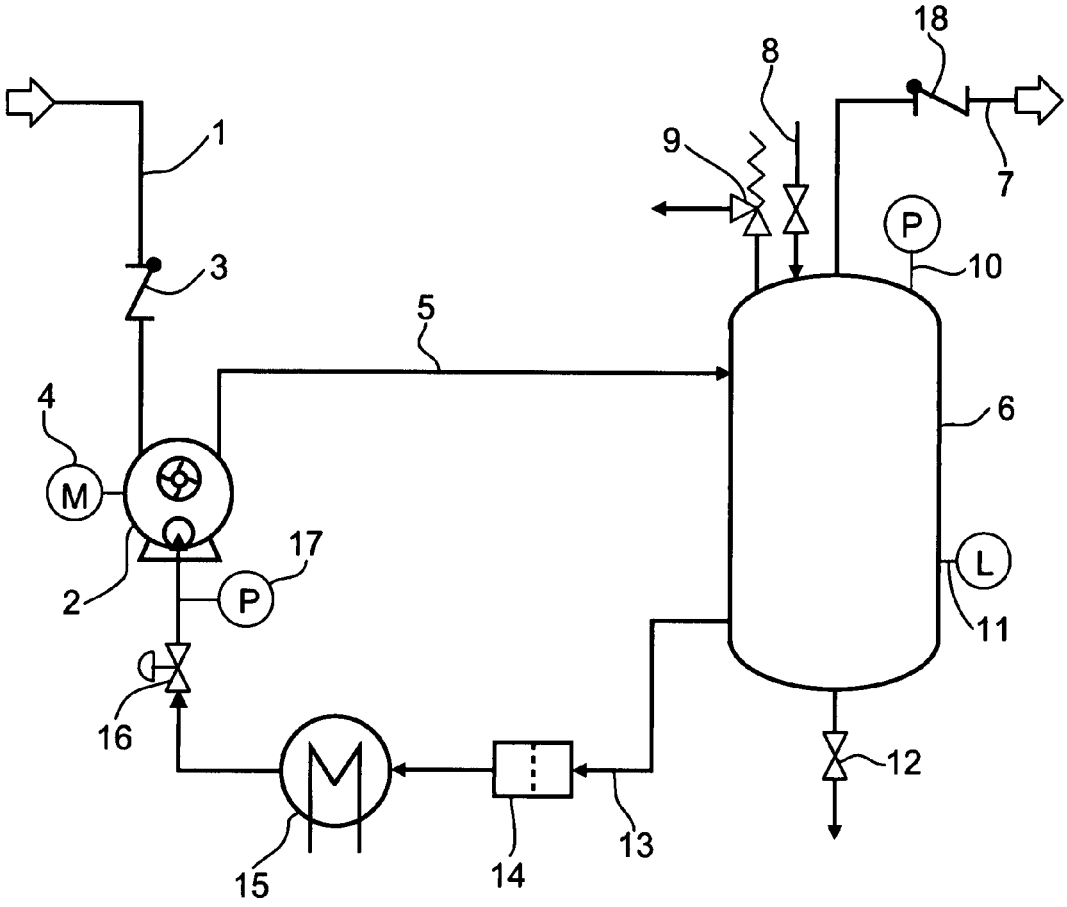

This application is a national stage application (under 35 U.S.C. 371) of PCT/EP2005/009981 filed Sep. 16, 2005, which claims the benefit of German application 10 2004 045 173.7 filed Sep. 17, 2004.

The invention relates to a method of operating a liquid ring compressor.

Liquid ring compressors have a wide range of uses. Thus, they are firstly used for compressing gases and can secondly be used as vacuum pumps for evacuating reactors, vessels or other plant components.

In a liquid ring compressor, an impeller with blades mounted on it is mounted eccentrically in a compressor body. A service liquid is present in the compressor body and is flung onto the wall of the compressor body as a result of the centrifugal forces generated by rotation of the impeller. In this way, the service liquid in the compressor body forms a circumferential liquid ring which forms chambers bounded in each case by two blades and the liquid ring. Owing to the eccentric positioning of the impeller in the compressor body, the size of the chambers decreases in the direction of rotation of the impeller. As a result of the formation of the liquid ring, a subatmospheric pressure is produced in the chambers. This draws in gas. Owing to the rotation of the impeller and the reduction in the size of the chambers, the gas which has been drawn in is compressed and ejected from the liquid ring compressor on the pressure side.

Such a liquid ring compressor is known, for example, from Wilhelm R. A. Vauck, Grundoperationen chemischer Verfahrenstechnik, 11th revised and expanded edition, Deutscher Verlag für Grundstoffindustrie, Stuttgart, 2000.

Customary service liquids used for operating the liquid ring compressor are, for example, water, organic solvents or oils.

A disadvantage of the service liquids known from the prior art when the liquid ring compressor is used as a vacuum pump is that the pressures which can be achieved on the suction side of the liquid ring compressor are limited by the vapor pressure of the service liquid. To achieve lower pressures, the service liquid is at present cooled, since the vapor pressure decreases with decreasing temperature. However, the solubility of gas in the service liquid increases as its temperature decreases. This means that more gas can be dissolved in the liquid as the temperature of the service liquid decreases. However, a larger amount of gas in the service liquid can lead to increasing formation of gas bubbles which lead to cavitation and thus to damage to the impeller and the blades.

A disadvantage of the service liquids known from the prior art when the liquid ring compressor is used for compressing gases is that part of the service liquid vaporizes and is ejected from the liquid ring compressor together with the compressed gas. To obtain a compressed gas which does not contain any vapor of the service liquid, the liquid ring compressor has to be followed by a complicated gas separation in which the vaporized service liquid is separated off from the gas.

It is an object of the present invention to develop a method of operating a liquid ring compressor which does not have the abovementioned disadvantages.

This object is achieved by a method of operating a liquid ring compressor having an impeller installed eccentrically in a compressor body, with gas being supplied to the liquid ring compressor on a suction side and gas being ejected from the liquid ring compressor on a pressure side, which comprises the following steps:

i) generation of a liquid ring on the inside of the compressor body by rotation of the impeller, ii) drawing of gas into chambers formed between the blades of the impeller and the liquid ring, iii) compression of the gas in the chambers which become smaller from the suction side to the pressure side as a result of the rotation and the eccentric positioning of the impeller, iv) ejection of the compressed gas on the pressure side, wherein an ionic liquid is used as service liquid for generation of the liquid ring.

Ionic liquids are, according to the definition of Peter Wasserscheid and Wilhelm Keim in Angewandte Chemie 2000, 112, pp. 3926 to 3945, salts which melt at relatively low temperatures (i.e. temperatures below 100° C.) and have a nonmolecular, ionic character. A particularly advantageous property of ionic liquids for use in liquid ring compressors is that they have no measurable vapor pressure. Thus, when the liquid ring compressor is used as a vacuum pump, it is even possible to achieve pressures below the vapor pressure of the service liquid used in the particular case. When the liquid ring compressor is used for compressing gases, no service liquid vaporizes, so that the compressed gas is free of impurities. Entrained liquid droplets can be separated from the gas by means of a simple droplet precipitator. A complicated gas/liquid separation can be dispensed with.

When the liquid ring compressor is used as a vacuum pump, the pressure on the suction side is less than atmospheric pressure and that on the pressure side is equal to atmospheric pressure. When the liquid ring compressor is used for compressing gases, the pressure on the suction side is equal to atmospheric pressure and that on the pressure side is greater than atmospheric pressure.

In one variant of the method, the gas ejected on the pressure side of the liquid ring compressor is passed to a liquid precipitator to separate off droplets of the service liquid which have been entrained in the gas. In a preferred variant of the method, the liquid which has been separated off in the liquid precipitator is returned to the liquid ring compressor. Here, the service liquid flows through a closed circuit, so that no service liquid is removed from the operation. Suitable liquid precipitators are, for example, knitted wire structures, beds of packing elements, ordered packing or other apparatuses known to those skilled in the art.

In a preferred variant of the method, the apparatuses through which the ionic liquid flows are maintained at the operating temperature by heating or cooling. The apparatuses through which the ionic liquid flows are, for example, the liquid ring compressor itself, the liquid precipitator, pumps required for conveying the ionic liquid and the pipes by means of which the individual apparatuses are connected to one another.

Heating of the apparatuses through which the ionic liquid flows also makes it possible to use ionic liquids whose melting point is above ambient temperature as service liquid.

The energy liberated on compression of the gas is taken up by the service liquid and is, if appropriate, removed by means of a heat exchanger in the pumped circuit of the liquid ring compressor.

The ionic liquid used for operation of the liquid ring compressor preferably has a viscosity in the range from 10 to 200 mPas. If the viscosity is above 200 mPas, the blades of the impeller can be torn off at the high speeds at which the impeller rotates because of the resistance offered by the liquid. Viscosities below 10 mPas can lead to gas bubbles displacing the liquid from a chamber as a result of the pressure decrease from the pressure side to the suction side and flowing around a blade into the next chamber. Such a gas connection between two chambers can lead to failure of the liquid ring compressor.

The ionic liquids used for operating the liquid ring compressor are preferably chemically inert and thermally stable at the operating temperature of the liquid ring compressor. Chemically inert means that the ionic liquid does not react with the gas to be compressed. Thermally stable means that the half life period for decomposition of the ionic liquid is greater than one year. Here, the half life period is the period of time over which a given initial amount of ionic liquid is reduced by half.

The ionic liquid is preferably not corrosive. This prevents the compressor body and the impeller together with blades of the liquid ring compressor from being corroded and thereby damaged. When hydrolysis-sensitive substances are used as service liquid, the liquid ring compressor can be operated with nitrogen blanketing. Here, nitrogen blanketing means that all of the apparatuses through which the ionic liquid flows are operated in the absence of atmospheric moisture or other traces of water by the apparatuses being flooded with nitrogen before being started up.

To ensure energetically advantageous operation of the liquid ring compressor, the operating temperature of the liquid ring compressor is preferably in the range from 25 to 100° C. These temperatures can be achieved at relatively low energy costs. At temperatures above 100° C., the costs of heating the liquid ring compressor increase greatly.

To be able to operate the liquid ring compressor at an operating temperature in the range from 25 to 100° C., the melting point of the ionic liquid is below 100° C., preferably below 70° C. and particularly preferably below 25° C.

Ionic liquids in the context of the present invention are salts of the general formula $$[A]_n^+[Y]^{n-}$$

where n=1, 2, 3 or 4,
or mixed species of the general formula $$[A^1]^+[A^2]^+[Y]^{2-},\ [A^1]^+[A^2]^+[A^3]^+[Y]^{3-} \text{ or } [A^1]^+[A^2]^+[A^3]^+[A^4]^+[Y]^{4-}$$

where $A^1$, $A^2$, $A^3$ and $A^4$ are selected independently from the groups specified for [A], or mixed species with metal cations $$[A^1]^+[A^2]^+[A^3]^+[M^1]^+[Y]^{4-},\ [A^1]^+[A^2]^+[M^1]^+[M^2]^+[Y]^{4-},\ [A^1]^+[M^1]^+[M^2]^+[M^3]^+[Y]^{4-},\ [A^1]^+[A^2]^+[M^1]^+[Y]^{3-},\ [A^1]^+[M^1]^+[M^2]^+[Y]^{3-},\ [A^1]^+[M^1]^+[Y]^{2-},\ [A^1]^+[A^2]^+[M^4]^{2+}[Y]^{4-},\ [A^1]^+[M^1]^+[M^4]^{2+}[Y]^{4-},\ [A^1]^+[M^5]^{3+}[Y]^{4-},\ [A^1]^+[M^4]^{2+}[Y]^{3-}$$

where $M^1$, $M^2$, $M^3$ are monovalent metal cations, $M^4$ is a divalent metal cation and $M^5$ is a trivalent metal cation.

Compounds which are suitable for forming the cations $[A]_n^+$ of ionic liquids are known, for example, from DE 102 02 838 A1. Thus, such compounds can contain oxygen, phosphorus, sulfur or in particular nitrogen atoms, for example at least one nitrogen atom, preferably 1-10 nitrogen atoms, particularly preferably 1-5 nitrogen atoms, very particularly preferably 1-3 nitrogen atoms and in particular 1-2 nitrogen atoms. It is also possible for further heteroatoms such as oxygen, sulfur or phosphorus atoms to be present. The nitrogen atom is a suitable carrier of the positive charge in the cation of the ionic liquid, from which a proton or an alkyl radical can then be transferred in equilibrium to the anion to produce an electrically neutral molecule.

In the synthesis of ionic liquids, a cation is firstly generated by quaternization of the nitrogen atom of, for instance, an amine or nitrogen heterocycle. Quaternization can be effected by protonation or alkylation of the nitrogen atom. Depending on the protonation or alkylation reagent used, salts having different anions are obtained. In cases in which it is not possible to form the desired anion in the quaternization itself, this is carried out in a further step of the synthesis. Starting, for example, from an ammonium halide, the halide can be reacted with a Lewis acid to form a complex anion from the halide and the Lewis acid. An alternative is replacement of a halide ion by the desired anion. This can be achieved by addition of a metal salt with precipitation of the metal halide formed, by means of an ion exchanger or by displacement of the halide ion by a strong acid (with liberation of the hydrohalic acid). Such processes are described, for example, in Angew. Chem. 2000, 112, pp. 3926-3945, and the references cited therein.

Suitable alkyl radicals by means of which the nitrogen atom in the amines or nitrogen heterocycles is quaternized are $C_1$-$C_{18}$-alkyl, preferably $C_1$-$C_{10}$-alkyl, particularly preferably $C_1$-$C_6$-alkyl and very particularly preferably methyl.

Preference is given to compounds comprising at least one five- to six-membered heterocycle which contains at least one nitrogen atom and, if appropriate, an oxygen or sulfur atom. Particular preference is given to compounds comprising at least one five- or six-membered heterocycle which has one, two or three nitrogen atoms and one sulfur atom or one oxygen atom, very particular preference to compounds of this type having two nitrogen atoms.

Particularly preferred compounds are those which have a molecular weight below 1000 g/mol, very particularly preferably below 500 g/mol and in particular below 250 g/mol.

Furthermore, preference is given to cations selected from among compounds of the formulae (Ia) to (It), (a)

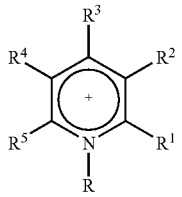

(b)

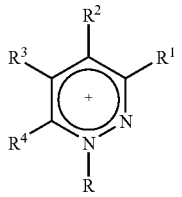

(c)

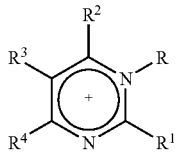

(d)

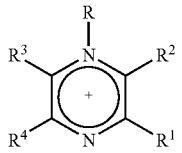

-continued
(e)
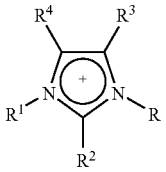
(f)
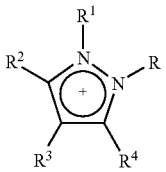
(g)
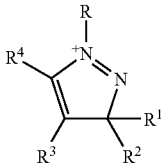
(g′)
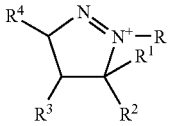
(h)
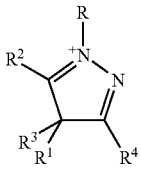
(i)
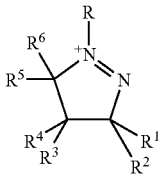
(j)
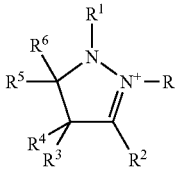
(j′)
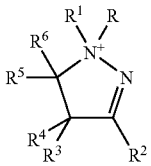
(k)
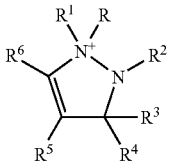
-continued
(k′)
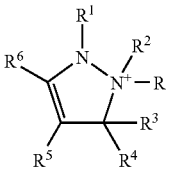
(l)
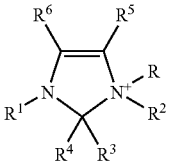
(m)
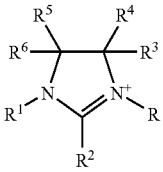
(m′)
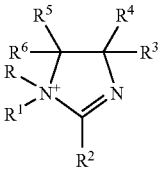
(n)
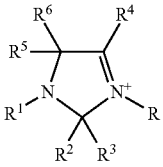
(n′)
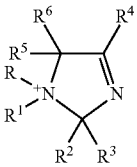
(o)
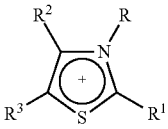
(o′)
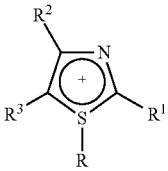
(p)
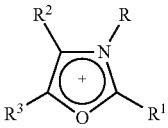

-continued (q)

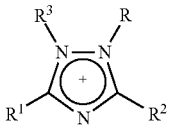

(q′)

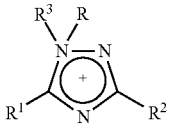

(q″)

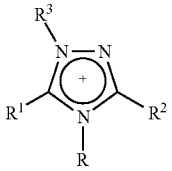

(r)

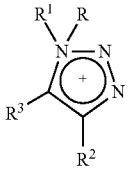

(r′)

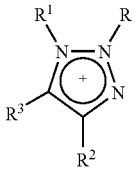

(r″)

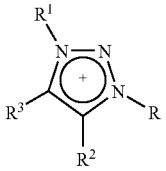

(s)

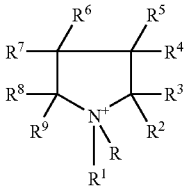

(t)

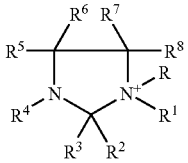

and also oligomers or polymers in which these structures are present, where the substituents and indices have the following meanings:

R is hydrogen or a $C_1$-$C_{18}$-alkyl radical, preferably a $C_1$-$C_{10}$-alkyl radical, particularly preferably a $C_1$-$C_6$-alkyl radical, for example methyl, ethyl, n-propyl, isopropyl, n-butyl, sec-butyl, tert-butyl, n-pentyl(n-amyl), 2-pentyl(sec-amyl), 3-pentyl, 2,2-dimethylprop-1-yl(neopentyl) and n-hexyl, very particularly preferably methyl.

$R^1$, $R^2$, $R^3$, $R^4$, $R^5$, $R^6$, $R^7$, $R^8$ and $R^9$ are each, independently of one another, hydrogen or $C_1$-$C_{18}$-alkyl, $C_2$-$C_{18}$-alkyl which may be interrupted by one or more nonadjacent oxygen and/or sulfur atoms and/or one or more substituted or unsubstituted imino groups, $C_6$-$C_{14}$-aryl, $C_5$-$C_{12}$-cycloalkyl or a five- or six-membered, oxygen-, nitrogen- and/or sulfur-containing heterocycle, or two of the radicals together may also form an unsaturated, saturated or aromatic ring which may be interrupted by one or more nonadjacent oxygen and/or sulfur atoms and/or one or more substituted or unsubstituted imino groups, where the radicals may each additionally be substituted by functional groups, aryl, alkyl, aryloxy, alkyloxy, halogen, heteroatoms and/or heterocycles.

$C_1$-$C_{18}$-alkyl which may be unsubstituted or bear functional groups, aryl, alkyl, aryloxy, alkyloxy, halogen, heteroatoms and/or heterocycles as substituents is, for example, methyl, ethyl, propyl, isopropyl, n-butyl, sec-butyl, tert-butyl, pentyl, hexyl, heptyl, octyl, 2-ethylhexyl, 2,4,4-trimethylpentyl, decyl, dodecyl, tetradecyl, heptadecyl, octadecyl, 1,1-dimethylpropyl, 1,1-dimethylbutyl, 1,1,3,3-tetramethylbutyl, benzyl, 1-phenylethyl, α,α-dimethylbenzyl, benzhydryl, p-tolylmethyl, 1-(p-butylphenyl)ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonylpropyl, 1,2-di(methoxycarbonyl)ethyl, 2-methoxyethyl, 2-ethoxyethyl, 2-butoxyethyl, diethoxymethyl, diethoxyethyl, 1,3-dioxolan-2-yl, 1,3-dioxan-2-yl, 2-methyl-1,3-dioxolan-2-yl, 4-methyl-1,3-dioxolan-2-yl, 2-isopropoxyethyl, 2-butoxypropyl, 2-octyloxyethyl, chloromethyl, trichloromethyl, trifluoromethyl, 1,1-dimethyl-2-chloroethyl, 2-methoxyisopropyl, 2-ethoxyethyl, butylthiomethyl, 2-dodecylthioethyl, 2-phenylthioethyl, 2,2,2-trifluoroethyl, 2-hydroxyethyl, 2-hydroxypropyl, 3-hydroxypropyl, 4-hydroxybutyl, 6-hydroxyhexyl, 2-aminoethyl, 2-aminopropyl, 3-aminopropyl, 4-aminobutyl, 6-aminohexyl, 2-methylaminoethyl, 2-methylaminopropyl, 3-methylaminopropyl, 4-methylaminobutyl, 6-methylaminohexyl, 2-dimethylaminoethyl, 2-dimethylaminopropyl, 3-dimethylaminopropyl, 4-dimethylaminobutyl, 6-dimethylaminohexyl, 2-hydroxy-2,2-dimethylethyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl or 6-ethoxyhexyl.

$C_2$-$C_{18}$-alkyl which may be interrupted by one or more nonadjacent oxygen and/or sulfur atoms and/or one or more substituted or unsubstituted imino groups is, for example, 5-hydroxy-3-oxapentyl, 8-hydroxy-3,6-dioxaoctyl, 11-hydroxy-3,6,9-trioxaundecyl, 7-hydroxy-4-oxaheptyl, 11-hydroxy-4,8-dioxaundecyl, 15-hydroxy-4,8,12-trioxapentadecyl, 9-hydroxy-5-oxanonyl, 14-hydroxy-5,10-oxatetradecyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

If two radicals form a ring, these radicals can together form, for example as fused-on building block, 1,3-propylene, 1,4-butylene, 2-oxa-1,3-propylene, 1-oxa-1,3-propylene, 2-oxa-1,3-propylene, 1-oxa-1,3-propenylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

The number of nonadjacent oxygen and/or sulfur atoms and/or imino groups in the ionic liquid is in principle not subject to any restrictions, or is restricted automatically by the size of the radical or of the cyclic building block. In general, it is not more than 5 per radical, preferably not more than 4, in particular not more than 3. Furthermore, there is/are generally at least one carbon atom, preferably at least two carbon atoms, present between two heteroatoms.

Substituted and unsubstituted imino groups can be, for example, imino, methylimino, isopropylimino, n-butylimino or tert-butylimino.

"Functional groups" are, for example, the following: carboxy, carboxamide, hydroxy, di($C_1$-$C_4$-alkyl)amino, $C_1$-$C_4$-alkyloxycarbonyl, cyano or $C_1$-$C_4$-alkyloxy. Here, $C_1$-$C_4$-alkyl is methyl, ethyl, propyl, isopropyl, n-butyl, sec-butyl or tert-butyl.

$C_6$-$C_{14}$-aryl which may be unsubstituted or bear functional groups, aryl, alkyl, aryloxy, alkyloxy, halogen, heteroatoms and/or heterocycles as substituents is, for example, phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-diethoxyphenyl, 2,6-dichlorophenyl, 4-bromophenyl, 2- or 4-nitrophenyl, 2,4- or 2,6-dinitrophenyl, 4-dimethylaminophenyl, 4-acetylphenyl, methoxyethylphenyl or ethoxyethylphenyl.

$C_5$-$C_{12}$-cycloalkyl which may be unsubstituted or bear functional groups, aryl, alkyl, aryloxy, alkyloxy, halogen, heteroatoms and/or heterocycles as substituents is, for example, cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl or a saturated or unsaturated bicyclic system such as norbornyl or norbornenyl.

A five- or six-membered, oxygen-, nitrogen- and/or sulfur-containing heterocycle which may be unsubstituted or bear the same groups as substituents is, for example, furyl, thiophenyl, pyrryl, pyridyl, indolyl, benzoxazolyl, dioxolyl, dioxyl, benzimidazolyl, benzothiazolyl, dimethylpyridyl, methylquinolyl, dimethylpyrryl, methoxyfuryl, dimethoxypyridyl, difluoropyridyl, methylthiophenyl, isopropylthiophenyl or tertbutylthiophenyl.

Preference is given to $R^1$, $R^2$, $R^3$, $R^4$, $R^5$, $R^6$, $R^7$, $R^8$ and $R^9$ each being, independently of one another, hydrogen, methyl, ethyl, n-butyl, 2-hydroxyethyl, 2-cyanoethyl, 2-(methoxycarbonyl)ethyl, 2-(ethoxycarbonyl)ethyl, 2-(n-butoxycarbonyl)ethyl, dimethylamino, diethylamino or chlorine.

Particularly preferred pyridinium ions (Ia) are those in which one of the radicals $R^1$ to $R^5$ is methyl, ethyl or chlorine and all others are hydrogen, or $R^3$ is dimethylamino and all others are hydrogen, or all the radicals are hydrogen, or $R^2$ is carboxy or carboxamide and all others are hydrogen, or $R^1$ and $R^2$ or $R^2$ and $R^3$ are together 1,4-buta-1,3-dienylene and all others are hydrogen.

Particularly preferred pyridazinium ions (Ib) are those in which one of the radicals $R^1$ to $R^4$ is methyl or ethyl and all others are hydrogen or all radicals are hydrogen.

Particularly preferred pyrimidinium ions (Ic) are those in which $R^2$ to $R^4$ are each hydrogen or methyl and $R^1$ is hydrogen, methyl or ethyl, or $R^2$ and $R^4$ are each methyl, $R^3$ is hydrogen and $R^1$ is hydrogen, methyl or ethyl.

Particularly preferred pyrazinium ions (Id) are those in which $R^1$ to $R^4$ are all methyl or are all hydrogen.

Particularly preferred imidazolium ions (Ie) are those in which, independently of one another, $R^1$ is selected from among methyl, ethyl, n-propyl, n-butyl, n-pentyl, n-octyl, 2-hydroxyethyl and 2-cyanoethyl and $R^2$ to $R^4$, independently of one another, are hydrogen, methyl or ethyl.

Particularly preferred pyrazolium ions (If) are those in which, independently of one another, $R^1$ is selected from among hydrogen, methyl and ethyl, $R^2$, $R^3$ and $R^4$ from among hydrogen and methyl.

Particularly preferred pyrazolium ions (Ig) and (Ig') are those in which, independently of one another, $R^1$ is selected from among hydrogen, methyl and ethyl and $R^2$, $R^3$ and $R^4$ are selected from among hydrogen and methyl.

Particularly preferred pyrazolium ions (Ih) are those in which, independently of one another, $R^1$ to $R^4$ are selected from among hydrogen and methyl.

Particularly preferred 1-pyrazolinium ions (Ii) are those in which, independently of one another, $R^1$ to $R^6$ are selected from among hydrogen and methyl.

Particularly preferred 2-pyrazolinium ions (Ij) and (Ij') are those in which, independently of one another, $R^1$ is selected from among hydrogen, methyl, ethyl and phenyl and $R^2$ to $R^6$ are selected from among hydrogen and methyl.

Particularly preferred 3-pyrazolinium ions (Ik) are those in which, independently of one another, $R^1$ and $R^2$ are selected from among hydrogen, methyl, ethyl and phenyl and $R^3$ to $R^6$ are selected from among hydrogen and methyl.

Particularly preferred imidazolinium ions (Il) are those in which, independently of one another, $R^1$ and $R^2$ are selected from among hydrogen, methyl, ethyl, n-butyl and phenyl and $R^3$ and $R^4$ are selected from among hydrogen, methyl and ethyl and $R^5$ and $R^6$ are selected from among hydrogen and methyl.

Particularly preferred imidazolinium ions (Im) and (Im') are those in which, independently of one another, $R^1$ and $R^2$ are selected from among hydrogen, methyl and ethyl and $R^3$ to $R^6$ are selected from among hydrogen and methyl.

Particularly preferred imidazolinium ions (In) and (In') are those in which, independently of one another, $R^1$, $R^2$ and $R^3$ are selected from among hydrogen, methyl and ethyl and $R^4$ to R5 are selected from among hydrogen and methyl.

Particularly preferred thiazolium ions (Io) and (Io') or oxazolium ions (Ip) and (Ip') are those in which, independently of one another, $R^1$ is selected from among hydrogen, methyl, ethyl and phenyl and $R^2$ and $R^3$ are selected from among hydrogen and methyl.

Particularly preferred 1,2,4-triazolium ions (Iq) are those in which, independently of one another, $R^1$ and $R^2$ are selected from among hydrogen, methyl, ethyl and phenyl and $R^3$ is selected from among hydrogen, methyl and phenyl.

Particularly preferred 1,2,3-triazolium ions (Ir), (Ir') and (Ir") are those in which, independently of one another, $R^1$ is selected from among hydrogen, methyl and ethyl and $R^2$ and $R^3$ are selected from among hydrogen and methyl or $R^2$ and $R^3$ are together 1,4-buta-1,3-dienylene and all others are hydrogen.

Particularly preferred pyrrolidinium ions (Is) are those in which, independently of one another, $R^1$ is selected from among hydrogen, methyl, ethyl and phenyl and $R^2$ to $R^9$ are selected from among hydrogen and methyl.

Particularly preferred imidazolium ions (II) are those in which, independently of one another, $R^1$ and $R^2$ are selected from among hydrogen, methyl, ethyl, n-butyl and phenyl and $R^3$ and $R^4$ are selected from among hydrogen, methyl and ethyl and $R^5$ and $R^6$ are selected from among hydrogen and methyl.

Among the abovementioned heterocyclic cations, preference is given to the pyridinium ions and the imidazolinium ions.

Very particular preference is given to imidazolinium ions (Ie) in which R, $R^1$ and $R^2$ are selected independently from among hydrogen, methyl, ethyl and butyl and $R^3$ and $R^4$ are each hydrogen.

Further suitable cations are quaternary ammonium ions of the formula (II)

$$NRR^aR^bR^{c+} \quad (II)$$

and quaternary phosphonium ions of the formula (III)

$$PRR^aR^bR^{c+} \quad (III).$$

$R^a$, $R^b$ and $R^c$ are each, independently of one another, $C_1$-$C_{18}$-alkyl, $C_2$-$C_{18}$-alkyl which may be interrupted by one or more nonadjacent oxygen and/or sulfur atoms and/or one or more substituted or unsubstituted imino groups, $C_6$-$C_{12}$-aryl, $C_5$-$C_{12}$-cycloalkyl or a five- or six-membered, oxygen-, nitrogen- and/or sulfur-containing heterocycle, or two of the radicals together form an unsaturated, saturated or aromatic ring which may be interrupted by one or more oxygen and/or sulfur atoms and/or one or more substituted or unsubstituted imino groups, where the radicals may each be substituted by functional groups, aryl, alkyl, aryloxy, alkyloxy, halogen, heteroatoms and/or heterocycles with the proviso that at least two of the three radicals $R^a$, $R^b$ and $R^c$ are different and the radicals $R^a$, $R^b$ and $R^c$ together have at least 8, preferably at least 10, particularly preferably at least 12 and very particularly preferably at least 13, carbon atoms.

R in the formulae is hydrogen or a $C_1$-$C_{18}$-alkyl radical, preferably a $C_1$-$C_{10}$-alkyl radical, particularly preferably a $C_1$-$C_6$-alkyl radical, for example methyl, ethyl, n-propyl, isopropyl, n-butyl, sec-butyl, tert-butyl, n-pentyl(n-amyl), 2-pentyl(sec-amyl), 3-pentyl, 2,2-dimethylprop-1-yl(neopentyl) and n-hexyl, very particularly preferably methyl.

Preference is given to $R^a$, $R^b$ and $R^c$ each being, independently of one another, $C_1$-$C_{18}$-alkyl, $C_6$-$C_{12}$-aryl or $C_5$-$C_{12}$-cycloalkyl, particularly preferably $C_1$-$C_{18}$-alkyl, where the radicals mentioned may each be substituted by functional groups, aryl, alkyl, aryloxy, alkyloxy, halogen, heteroatoms and/or heterocycles.

Examples of the respective groups have been given above.

The radicals $R^a$, $R^b$ and $R^c$ are preferably methyl, ethyl, n-propyl, isopropyl, n-butyl, sec-butyl, tert-butyl, n-pentyl(n-amyl), 2-pentyl(sec-amyl), 3-pentyl, 2,2-dimethylprop-1-yl (neopentyl), n-hexyl, n-heptyl, n-octyl, isooctyl, 2-ethylhexyl, 1,1-dimethylpropyl, 1,1-dimethylbutyl, benzyl, 1-phenylethyl, 2-phenylethyl, 1,1-dimethylbenzyl, phenyl, tolyl, xylyl, α-naphthyl, β-naphthyl, cyclopentyl or cyclohexyl.

If two radicals $R^a$, $R^b$ and $R^c$ form a chain, this can be, for example, 1,4-butylene or 1,5-pentylene.

Examples of tertiary amines from which the quaternary ammonium ions of the general formula (II) are derivated by quaternization by means of the abovementioned radicals R are diethyl-n-butylamine, diethyl-tert-butylamine, diethyl-n-pentylamine, diethyl-hexylamine, diethyloctylamine, diethyl (2-ethylhexyl)amine, di-n-propylbutylamine, di-n-propyl-n-pentylamine, di-n-propylhexylamine, di-n-propyloctylamine, di-n-propyl(2-ethylhexyl)amine, diisopropylethylamine, diisopropyl-n-propylamine, diisopropyl-butylamine, diisopropylpentylamine, diisopropylhexylamine, diisopropyloctylamine, di-isopropyl(2-ethylhexyl)amine, di-n-butylethylamine, di-n-butyl-n-propylamine, di-n-butyl-n-pentylamine, di-n-butylhexylamine, di-n-butyloctylamine, di-n-butyl(2-ethylhexyl)-amine, N-n-butylpyrrolidine, N-sec-butylpyrrolidine, N-tert-butylpyrrolidine, N-n-pentylpyrrolidine, N,N-dimethylcyclohexylamine, N,N-diethylcyclohexylamine, N,N-di-n-butylcyclohexylamine, N-n-propylpiperidine, N-isopropylpiperidine, N-n-butylpiperidine, N-sec-butylpiperidine, N-tert-butylpiperidine, N-n-pentylpiperidine, N-n-butylmorpholine, N-sec-butylmorpholine, N-tert-butylmorpholine, N-n-pentylmorpholine, N-benzyl-N-ethylaniline, N-benzyl-N-n-propylaniline, N-benzyl-N-isopropylaniline, N-benzyl-N-n-butylaniline, N,N-dimethyl-p-toluidine, N,N-diethyl-p-toluidine, N,N-di-n-butyl-p-toluidine, diethylbenzylamine, di-n-propylbenzylamine, di-n-butylbenzylamine, diethylphenylamine, di-n-propylphenylamine and di-n-butylphenylamine.

Preferred tertiary amines are diisopropylethylamine, diethyl-tert-butylamine, diisopropylbutylamine, di-n-butyl-n-pentylamine, N,N-di-n-butylcyclohexylamine and also tertiary amines derived from pentyl isomers.

Particularly preferred tertiary amines are di-n-butyl-n-pentylamine and tertiary amines derived from pentyl isomers. A further preferred tertiary amine which has three identical radicals is triallylamine.

A particularly preferred tertiary ammonium ion is methyltributylammonium.

Further suitable cations are guanidinium ions of the general formula (IV)

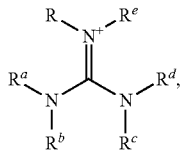

(IV)

where

R is as defined above, and the radicals $R^a$ to $R^e$ are each, independently of one another, carbon-containing organic, saturated or unsaturated, acyclic or cyclic, aliphatic, aromatic or araliphatic radicals which have from 1 to 20 carbon atoms and may be unsubstituted or be interrupted or substituted by from 1 to 5 heteroatoms or functional groups, where the radicals $R^a$ and $R^c$ may, independently of one another, also be hydrogen; or the radicals $R^a$ and $R^b$ and/or $R^c$ and $R^d$, in each case independently of one another, together form a divalent, carbon-containing organic, saturated or unsaturated, acyclic or cyclic, aliphatic, aromatic or araliphatic radical which has from 1 to 30 carbon atoms and may be unsubstituted or interrupted or substituted by from 1 to 5 heteroatoms or functional groups and the remaining radical(s) is/are as defined above; or the radicals $R^b$ and $R^c$ together form a divalent, carbon-containing organic, saturated or unsaturated, acyclic or cyclic, aliphatic, aromatic or araliphatic radical which has from 1 to 30 carbon atoms and may be unsubstituted or interrupted or substituted by from 1 to 5 heteroatoms or functional groups and the remaining radicals are as defined above. Otherwise, the radicals $R^a$-$R^e$ have the meanings defined above for $R^a$-$R^c$.

As anions, it is in principle possible to use all anions.

The anion $[Y]^{n-}$ of the ionic liquid is, for example, selected from the group of halides and halogen-containing compounds of the formulae:

$F^-$, $Cl^-$, $Br^-$, $I^-$, $BF_4^-$, $PF_6^-$, $AlCl_4^-$, $Al_2Cl_7^-$, $Al_3Cl_{10}^-$, $AlBr_4^-$, $FeCl_4^-$, $BCl_4^-$, $SbF_6^-$, $AsF_6^-$, $ZnCl_3^-$, $SnCl_3^-$, $CuCl_2^-$, $CF_3SO_3^-$, $(CF_3SO_2)_2N^-$, $CF_3CO_2^-$, $CCl_3CO_2^-$, $CN^-$, $SCN^-$, $OCN^-$ the group of sulfates, sulfites and sulfonates of the general formulae:

$SO_4^{2-}$, $HSO_4^-$, $SO_3^{2-}$, $HSO_3^-$, $R^aOSO_3^-$, $R^aSO_3^-$ the group of phosphates of the general formulae $PO_4^{3-}$, $HPO_4^{2-}$, $H_2PO_4^-$, $R^aPO_4^{2-}$, $HR^aPO_4^-$, $R^aR^bPO_4^-$ the group of phosphonates and phosphinates of the general formulae:

$R^aHPO_3^-$, $R^aR^bPO_2^-$, $R^aR^bPO_3^-$ the group of phosphites of the general formulae:

$PO_3^{3-}$, $HPO_3^{2-}$, $H_2PO_3^-$, $R^aPO_3^{2-}$, $R^aHPO_3^-$, $R^aR^bPO_3^-$ the group of phosphonites and phosphinites of the general formulae:

$R^aR^bPO_2^-$, $R^aHPO_2^-$, $R^aR^bPO^-$, $R^aHPO^-$ the group of carboxylic acids of the general formula:

$R^aCOO^-$ the group of borates of the general formulae:

$BO_3^{3-}$, $HBO_3^{2-}$, $H_2BO_3^-$, $R^aR^bBO_3^-$, $R^aHBO_3^-$, $R^aBO_3^{2-}$, $B(OR^a)(OR^b)(OR^c)(OR^d)^-$, $B(HSO_4)_4^-$, $B(RSO_4)_4^-$ the group of boronates of the general formulae:

$R^aBO_2^{2-}$, $R^aR^bBO^-$ the group of carbonates and carbonic esters of the general formulae:

$HCO_3^-$, $CO_3^{2-}$, $R^aCO_3^-$ the group of silicates and silicic esters of the general formulae:

$SiO_4^{4-}$, $HSiO_4^{3-}$, $H_2SiO_4^{2-}$, $H_3SiO_4^-$, $R^aSiO_4^{3-}$, $R^aR^bSiO_4^{2-}$, $R^aR^bR^cSiO_4^-$, $HR^8SiO_4^{2-}$, $H_2R^aSiO_4^-$, $HR^aR^bSiO_4^-$ the group of alkylsilane or arylsilane salts of the general formulae:

$R^aSiO_3^{3-}$, $R^aR^bSiO_2^{2-}$, $R^aR^bR^cSiO^-$, $R^aR^bR^cSiO_3^-$, $R^aR^bR^cSiO_2^-$, $R^aR^bSiO_3^{2-}$ the group of carboximides, bis(sulfonyl)imides and sulfonylimides of the general formulae:

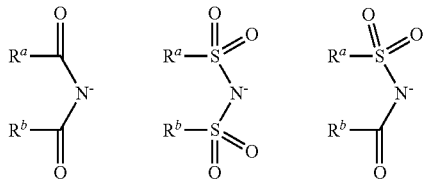

the group of alkoxides and aryloxides of the general formula:

$R^aO^-$ the group of complex metal ions such as $Fe(CN)_6^{3-}$, $Fe(CN)_6^{4-}$, $MnO_4^-$, $Fe(CO)_4^-$.

In these formulae, $R^a$, $R^b$, $R^c$ and $R^d$ are each, independently of one another, hydrogen, $C_1$-$C_{18}$-alkyl, $C_2$-$C_{18}$-alkyl which may be interrupted by one or more nonadjacent oxygen and/or sulfur atoms and/or one or more substituted or unsubstituted imino groups, $C_6$-$C_{14}$-aryl, $C_5$-$C_{12}$-cycloalkyl or a five- or six-membered, oxygen-, nitrogen- and/or sulfur-containing heterocycle, or two of the radicals together form an unsaturated, saturated or aromatic ring which may be interrupted by one or more oxygen and/or sulfur atoms and/or one or more substituted or unsubstituted imino groups, where the radicals may each additionally be substituted by functional groups, aryl, alkyl, aryloxy, alkyloxy, halogen, heteroatoms and/or heterocycles.

Here, $C_1$-$C_{18}$-alkyl which may be unsubstituted or bear functional groups, aryl, alkyl, aryloxy, alkyloxy, halogen, heteroatoms and/or heterocycles as substituents is, for example, methyl, ethyl, propyl, isopropyl, n-butyl, sec-butyl, tert-butyl, pentyl, hexyl, heptyl, octyl, 2-ethylhexyl, 2,4,4-trimethylpentyl, decyl, dodecyl, tetradecyl, heptadecyl, octadecyl, 1,1-dimethylpropyl, 1,1-dimethylbutyl, 1,1,3,3-tetramethylbutyl, benzyl, 1-phenylethyl, α,α-dimethylbenzyl, benzhydryl, p-tolylmethyl, 1-(p-butylphenyl)ethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonylpropyl, 1,2-di(methoxycarbonyl)ethyl, 2-methoxyethyl, 2-ethoxyethyl, 2-butoxyethyl, diethoxymethyl, diethoxyethyl, 1,3-dioxolan-2-yl, 1,3-dioxan-2-yl, 2-methyl-1,3-dioxolan-2-yl, 4-methyl-1,3-dioxolan-2-yl, 2-isopropoxyethyl, 2-butoxypropyl, 2-octyloxyethyl, chloromethyl, trichloromethyl, trifluoromethyl, 1,1-dimethyl-2-chloroethyl, 2-methoxyisopropyl, 2-ethoxyethyl, butylthiomethyl, 2-dodecylthioethyl, 2-phenylthioethyl, 2,2,2-trifluoroethyl, 2-hydroxyethyl, 2-hydroxypropyl, 3-hydroxypropyl, 4-hydroxybutyl, 6-hydroxyhexyl, 2-aminoethyl, 2-aminopropyl, 3-aminopropyl, 4-aminobutyl, 6-aminohexyl, 2-methylaminoethyl, 2-methylaminopropyl, 3-methylaminopropyl, 4-methylaminobutyl, 6-methylaminohexyl, 2-dimethylaminoethyl, 2-dimethylaminopropyl, 3-dimethylaminopropyl, 4-dimethylaminobutyl, 6-dimethylaminohexyl, 2-hydroxy-2,2-dimethylethyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl or 6-ethoxyhexyl.

$C_2$-$C_{18}$-alkyl which may be interrupted by one or more nonadjacent oxygen and/or sulfur atoms and/or one or more substituted or unsubstituted imino groups is, for example, 5-hydroxy-3-oxapentyl, 8-hydroxy-3,6-dioxaoctyl, 11-hydroxy-3,6,9-trioxaundecyl, 7-hydroxy-4-oxaheptyl, 11-hydroxy-4,8-dioxaundecyl, 15-hydroxy-4,8,12-trioxapentadecyl, 9-hydroxy-5-oxanonyl, 14-hydroxy-5,10-oxatetradecyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxaundecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

If two radicals form a ring, these radicals can together form, for example as fused-on building block, 1,3-propylene, 1,4-butylene, 2-oxa-1,3-propylene, 1-oxa-1,3-propylene, 2-oxa-1,3-propylene, 1-oxa-1,3-propenylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

The number of nonadjacent oxygen and/or sulfur atoms and/or imino groups is in principle not subject to any restrictions, or is restricted automatically by the size of the radical or of the cyclic building block. In general, it is not more than 5 per radical, preferably not more than 4, in particular not more than 3. Furthermore, there is/are generally at least one carbon atom, preferably at least two carbon atoms, present between two heteroatoms.

Substituted and unsubstituted imino groups can be, for example, imino, methylimino, isopropylimino, n-butylimino or tert-butylimino.

"Functional groups" are, for example, the following: carboxy, carboxamide, hydroxy, di($C_1$-$C_4$-alkyl)amino, $C_1$-$C_4$-alkyloxycarbonyl, cyano or $C_1$-$C_4$-alkyloxy. Here, $C_1$-$C_4$-alkyl is methyl, ethyl, propyl, isopropyl, n-butyl, sec-butyl or tert-butyl.

$C_6$-$C_{14}$-Aryl which may be unsubstituted or bear functional groups, aryl, alkyl, aryloxy, alkyloxy, halogen, heteroatoms and/or heterocycles as substituents is, for example, phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-diethoxyphenyl, 2,6-dichlorophenyl, 4-bromophenyl, 2- or 4-nitrophenyl, 2,4- or 2,6-dinitrophenyl, 4-dimethylaminophenyl, 4-acetylphenyl, methoxyethylphenyl or ethoxyethylphenyl.

$C_5$-$C_{12}$-Cycloalkyl which may be unsubstituted or bear functional groups, aryl, alkyl, aryloxy, alkyloxy, halogen, heteroatoms and/or heterocycles as substituents is, for example, cyclopentyl, cyclohexyl, cyclooctyl, cyclododecyl, methylcyclopentyl, dimethylcyclopentyl, methylcyclohexyl, dimethylcyclohexyl, diethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl or a saturated or unsaturated bicyclic system such as norbornyl or norbornenyl.

A five- or six-membered, oxygen-, nitrogen- and/or sulfur-containing heterocycle is, for example, furyl, thiophenyl, pyrryl, pyridyl, indolyl, benzoxazolyl, dioxolyl, dioxyl, benzimidazolyl, benzothiazolyl, dimethylpyridyl, methylquinolyl, dimethylpyrryl, methoxyfuryl, dimethoxypyridyl, difluoropyridyl, methylthiophenyl, isopropylthiophenyl or tert-butylthiophenyl.

Very particularly preferred anions are $Cl^-$, $SCN^-$, $SO_4^{2-}$, $HSO_4^-$, $R^aSO_3^-$, $R^aOSO_3^-$, $R_aR_bPO_4^-$, $R^aCOO^-$ and $B(HSO_4)_4^-$, where $R^a$ and $R^b$ are each selected independently from between methyl and ethyl.

Preferred ionic liquids for use in liquid ring compressors are, for example, methyltributylammonium sulfate, 1-methylimidazolium chloride, 1-methylimidazolium hydrogensulfate, 1-ethyl-3-methylimidazolium chloride, 1-ethyl-3-methylimidazolium hydrogensulfate, 1-ethyl-3-methylimidazolium methylsulfonate, 1-ethyl-3-methylimidazolium diethylphosphate, 1-ethyl-3-methylimidazolium thiocyanate, 1-ethyl-3-methylimidazolium acetate, 1-ethyl-3-methylimidazolium monoethylsulfate, 1-butyl-3-methylimidazolium chloride, 1-butyl-3-methylimidazolium hydrogensulfate, 1-butyl-3-methylimidazolium methylsulfonate, 1-butyl-3-methylimidazolium dimethylphosphate, 1-butyl-3-methylimidazolium thiocyanate, 1-butyl-3-methylimidazolium acetate, 1-butyl-3-methylimidazolium monomethylsulfate, 1-ethyl-2,3-dimethylimidazolium monoethylsulfate, 1-ethyl-2,3-dimethylimidazolium dimethylphosphate, 1-ethyl-2,3-dimethylimidazolium diethylphosphate, 1,2,3-trimethylimidazolium dimethylphosphate, 1,2,3-trimethylimidazolium diethylphosphate and mixtures thereof.

Ionic liquids which are not corrosive and even have a passivating action are particularly preferred for use as service liquid in a liquid ring compressor. These include, in particular, ionic liquids having sulfate, phosphate, borate, tetrakishydrogensulfatoborate or silicate anions. Particular preference is given to solutions of inorganic salts in ionic liquids and also ionic liquids containing metal cations and having the formula $[A^1]^+[M^1]^+[Y]^{2-}$, which results in improved thermal stability of the ionic liquid. Very particular preference is given to using alkali metals and alkaline earth metals or their salts for this purpose.

Since the ionic liquids do not vaporize and the compressed gas thus does not become contaminated during compression in a liquid ring compressor, liquid ring compressors operated using an ionic liquid can also be used for compressing gases which after compression are introduced in pure form into a column or a reactor. Thus, for example, gases subjected to heterogeneously catalyzed reactions have to meet particularly stringent purity requirements.

Ionic liquids can also be used in the compression of gases in the case of which a solid precipitates during compression. Thus, for example, sulfur precipitates in the compression of $H_2S$. When $H_2S$ is compressed using dry compressors, the precipitating sulfur leads to damage to, in particular, the seals of the dry compressor and thus to decreasing compressor performance during operation. On the other hand, when a liquid ring compressor operated by means of an ionic liquid is used, the precipitating sulfur is dissolved in the ionic liquid. Furthermore, the hydrogen sulfide is not contaminated by evaporation of the service liquid, since the ionic liquid does not vaporize.

The ionic liquid entrained in the form of droplets in the gas during compression of the gas can, for example, be separated off from the gas stream by means of a demister located downstream of the liquid ring compressor.

Figure 2:
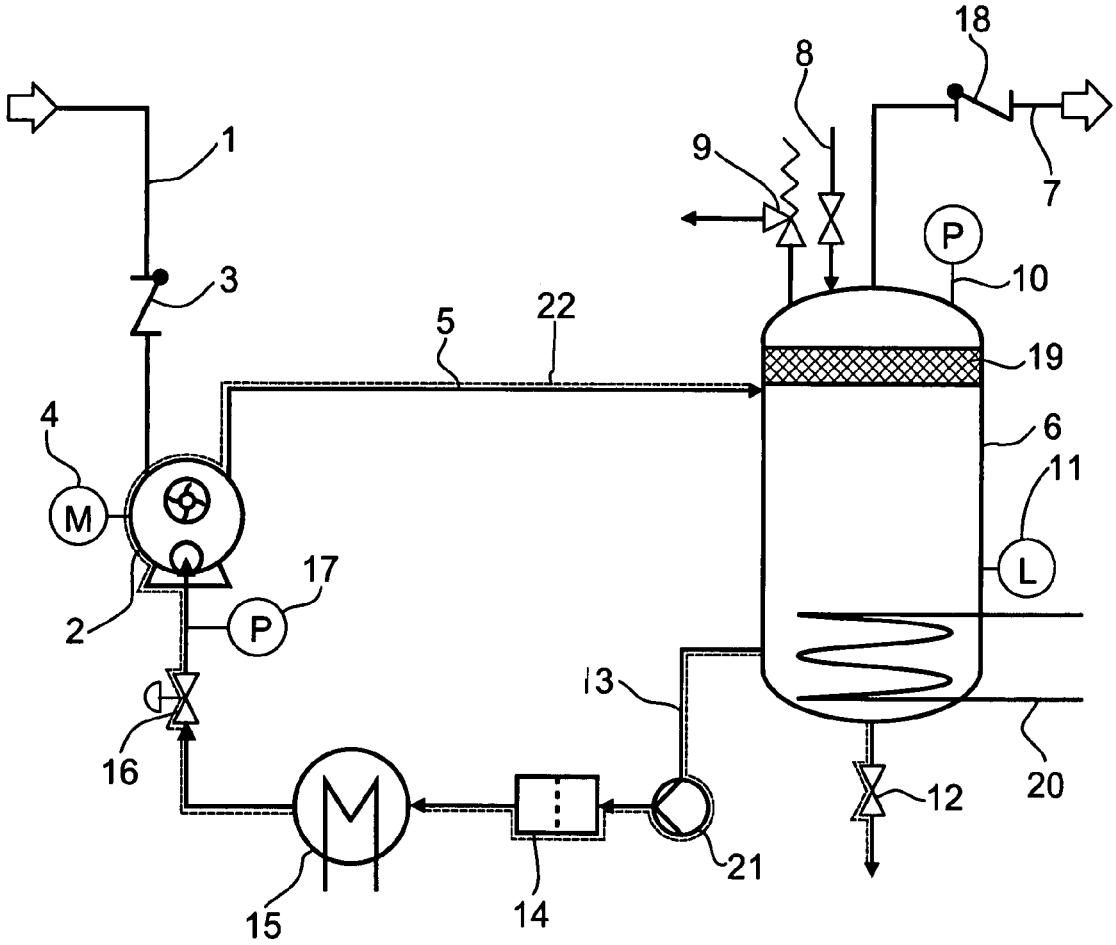

The invention is described in more detail below with the aid of a drawing. In the drawing:

FIG. 1 shows a process flow diagram for operation of a liquid ring compressor in a first embodiment, FIG. 2 shows a process flow diagram for operation of a liquid ring compressor in a second embodiment.

The gas to be compressed is fed via a feed line 1 to a liquid ring compressor 2. To prevent any gas from flowing back from the liquid ring compressor 2 via the feed line 1, the feed line 1 is provided with a nonreturn valve 3. The gas fed in is compressed in the liquid ring compressor 2. For this purpose, an impeller is mounted eccentrically in the liquid ring compressor 2. The impeller is preferably driven by an electric motor 4. A service liquid is present in the liquid ring compressor 2 and flows against the compressor body as a result of the centrifugal force produced by rotation of the impeller. This forms a liquid ring in the compressor body. The amount of service liquid is selected so that the ends of blades mounted on the impeller dip into the liquid, even when the liquid ring has formed. In this way, chambers bounded in each case by two blades and the service liquid are formed in the liquid ring compressor 2. As a result of the outward-flowing liquid and the increase in the size of the chamber, resulting from rotation, from the pressure side to the suction side due to the eccentric positioning of the impeller, subatmospheric pressure is produced in the chamber and this draws in the gas via the feed line 1 on the suction side of the liquid ring compressor 2. The eccentric installation of the impeller in the liquid ring compressor 2 leads to the volume of the individual chambers decreasing during rotation from the suction side to the pressure side. The gas is in this way compressed in the chambers during rotation of the impeller. The compressed gas is passed via a connecting line 5 to a liquid precipitator 6. In a preferred embodiment, the liquid precipitator 6 simultaneously serves as stock vessel for the service liquid. In the liquid precipitator 6, the service liquid entrained in the gas is separated off.

The compressed gas from which the service liquid has been removed is taken off via an outlet line 7.

In the embodiment depicted here, the liquid precipitator 6 is provided with an inlet pipe 8 via which the service liquid can be introduced into the process. Furthermore, the liquid precipitator 6 is provided with a safety valve 9 which opens when the pressure in the liquid precipitator 6 exceeds the permissible operating pressure. The pressure in the liquid precipitator 6 is monitored by means of the pressure gauge 10. The amount of service liquid in the liquid precipitator 6 is monitored by means of a liquid level indicator 11.

When the permissible amount of liquid in the liquid precipitator is exceeded, part of the service liquid can be drained from the liquid precipitator 6 via a drainage valve 12.

The service liquid which has been lost from the liquid ring compressor 2 by entrainment in the compressed gas is replaced via a return line 13.

The return line 13 is provided with a filter 14 in which solid particles are separated off from the service liquid. Solid particles which accumulate in the service liquid are, for example, metal particles which can be formed by cavitation on the impeller or on the body of the liquid ring compressor.

Furthermore, the return line 13 is provided with a heat exchanger 15 in which the service liquid is heated or cooled to the operating temperature.

The flow of the service liquid flowing back is set by means of a flow regulation valve 16 so that the amount of liquid in the liquid ring compressor 2 remains constant.

The pressure of the service liquid flowing back is monitored by means of a pressure gauge 17 which is likewise installed on the return line 13.

To prevent gas flowing back via the outlet line 7 into the liquid precipitator 6, the outlet line 7 is provided with a nonreturn valve 18.

In addition to the embodiment shown in FIG. 1, a demister 19 is installed in the liquid precipitator 6 in FIG. 2. In the demister 19, liquid droplets are separated off from the gas. Suitable demisters 19 are, for example, knitted wire structures, random packing elements or ordered packing.

To control the temperature of the service liquid, a heat exchanger 20 is additionally installed in the liquid precipitator 6. The service liquid can be heated or cooled to the operating temperature by means of the heat exchanger 20. Suitable types of heat exchanger 20 are, for example, shell-and-tube heat exchangers, a single pipe coil or a double jacket, through which a heat transfer medium flows in each case. Heat transfer media are, for example, heat transfer oils, water or steam. Apart from heating by means of liquid or gaseous heat transfer media, the service liquid can also be electrically heated.

Furthermore, a pump 21 is installed in the return line 13 in the embodiment shown in FIG. 2. The pump 21 forces the service liquid via the return line 13 into the liquid ring compressor 2. The pump 21 is required, in particular, for starting up the compressor apparatus, so that the amount of service liquid required for operating the liquid ring compressor 2 is transported from the liquid precipitator 6 to the liquid ring compressor 2.

The broken line in FIG. 2 denotes a supplementary heating facility 22. This is necessary particularly when the temperature of the service liquid is very different from ambient temperature. The supplementary heating facility 22 ensures that the service liquid is maintained at a constant temperature. Particularly in the case of ionic liquids whose melting point is above ambient temperature, the supplementary heating facility 22 can prevent it from becoming solid and operation of the liquid ring compressor 2 thus being disrupted. In the variant shown in FIG. 2, the supplementary heating facility heats the connecting line 5, the return line 13, the pump 21, the filter 14, the flow regulation valve 16 and the liquid ring compressor 2. Apart from heating all apparatuses through which the service liquid flows, it is also possible to heat only individual apparatuses or lines.

Furthermore, it is possible to provide cooling in place of the supplementary heating facility 22 and to cool the apparatuses and lines through which the service liquid flows.

To prevent the drainage valve 12 and the associated line from becoming blocked by solidifying ionic liquid, especially in the case of ionic liquids whose melting point is above ambient temperature, these are likewise provided with a supplementary heating facility in the embodiment shown here.

EXAMPLE

To examine the suitability of an ionic liquid as service liquid for a liquid ring compressor, the viscosity was determined in each case at room temperature (25° C.) and at 80° C.

Ionic liquids whose viscosity is in the range from 10 to 200 mPas are suitable as service liquids for liquid ring compressors.

The viscosities at 25° C. and 80° C. are shown in the following table:

| Ionic liquid | Viscosity at 25° C. mPa * s | Viscosity at 80° C. mPa * s |
|---|---|---|
| HMIM Cl | | 107.3 |
| HMIM $HSO_4$ | 923 | 76.1 |
| MTBS | | 81.1 |
| EMIM Cl | | 47.4 |
| EMIM $HSO_4$ | 1650 | 105 |
| EMIM DEP | 109.4 | 13.4 |
| EMIM SCN | 21.6 | 5.8 |
| EMIM acetate | 93.1 | 9.7 |
| EMIM $EtOSO_3$ | 122.4 | 14.3 |
| BMIM Cl | | 146.8 |
| BMIM $HSO_4$ | 4320 | 164.3 |
| BMIM $CH_3SO_3$ | | 100° C.: 15.7 |
| BMIM DMP | 579.3 | 33.8 |
| BMIM SCN | 53.5 | 9.34 |
| BMIM acetate | 554 | 22.4 |
| BMIM $MeOSO_3$ | 213.8 | 19.1 |
| EMMIM $EtOSO_3$ | | 46.1 |
| MMMIM/EMMIM - DMP/DEP | | 22.7 (at 120° C.) |

The ionic liquids for which no viscosity at 25° C. is reported are still in the solid state at this temperature.

The measured viscosities show that the ionic liquids can, depending on their composition, be used at various temperatures. Thus, EMIM $CH_3SO_3$, EMIM DEP, EMIM SCN, EMIM acetate, EMIM $EtOSO_3$ and BMIM SCN can be used as service liquid for liquid ring compressors even at an operating temperature of 25° C.

HMIM Cl, HMIM $HSO_4$, MTBS, EMIM Cl, EMIM $HSO_4$, EMIM $CH_3SO_3$, EMIM DEP, EMIM $EtOSO_3$, BMIM Cl, BMIM $HSO_4$, BMIM DMP, BMIM acetate, BMIM $MeOSO_3$, EMIM $EtOSO_3$ and MMIM/EMIM-DMP/DEP can be used at an operating temperature of 80° C.

It can be seen from the values given in the table that the viscosity decreases with increasing temperature.

In the case of ionic liquids whose viscosity at the operating temperature is only a little higher than 10 mPas, care therefore has to be taken to ensure that the service liquid is not heated further and is cooled, for example, in a heat exchanger installed in the liquid circuit.

Analogously, in the case of ionic liquids whose viscosity at the operating temperature is only slightly below 200 mPas, care has to be taken to ensure that the operating temperature does not drop further in the liquid ring compressor.

Finally, it can be seen from the table that EMIM $CH_3SO_3$, EMIM DEP and EMIM $EtOSO_3$, in particular, can be used both at 25° C. and at 80° C. and thus over a wide temperature range.

LIST OF REFERENCE NUMERALS

1 Feed line
2 Liquid ring compressor
3 Nonreturn valve
4 Electric motor
5 Connecting line
6 Liquid precipitator
7 Outlet line
8 Inlet pipe
9 Safety valve
10 Pressure gauge
11 Liquid level indicator
12 Drainage valve
13 Return line
14 Filter
15 Heat exchanger
16 Flow regulation valve
17 Pressure gauge
18 Nonreturn valve
19 Demister
20 Heatexchanger
21 Pump
22 Supplementary heating facility

The invention claimed is:

1. A method of operating a liquid ring compressor having an impeller installed eccentrically in a compressor body, with gas being supplied to the liquid ring compressor on a suction side and gas being ejected from the liquid ring compressor on a pressure side, which comprises the following steps:

i) generating a liquid ring on the inside of the compressor body by rotation of an impeller mounted eccentrically in the body, ii) drawing of gas into chambers formed between blades of the impeller and the liquid ring, iii) compressing the gas in the chambers which become smaller from the suction side to the pressure side as a result of the rotation and the eccentric positioning of the impeller, iv) ejecting the compressed gas on the pressure side and passing the gas ejected on the pressure side to a liquid precipitator, wherein an ionic liquid is used as service liquid for generation of the liquid ring.

2. The method according to claim 1, wherein the pressure on the suction side is less than atmospheric pressure and that on the pressure side is equal to atmospheric pressure.

3. The method according to claim 1, wherein the pressure on the suction side is equal to atmospheric pressure and that on the pressure side is greater than atmospheric pressure.

4. The method according to claim 1, including returning the liquid separated off in the liquid precipitator to the liquid ring compressor.

5. The method according to claim 1, including heating or cooling apparatuses through which the ionic liquid flows to maintain the apparatuses at the operating temperature.

6. The method according to claim 1, wherein the ionic liquid has a viscosity in the range from 10 to 200 mPas at the operating temperature of the liquid ring compressor.

7. The method according to claim 1, wherein the ionic liquid is chemically inert and thermally stable at the operating temperature of the liquid ring compressor.

8. The method according to claim 1, wherein the ionic liquid is not corrosive.

9. The method according to claim 1, wherein the ionic liquid has a melting point below 100° C.

10. The method according to claim 1, wherein the operating temperature of the liquid ring compressor is in the range from 25 to 100° C.

11. The method according to claim 1, wherein the ionic liquid contains sulfate, hydrogensulfate, alkylsulfate, thiocyanate, phosphate, borate, tetrakis-hydrogensulfatoborate or silicate ions.

* * * * *